US008317169B1

(12) United States Patent
Cantolino

(10) Patent No.: US 8,317,169 B1
(45) Date of Patent: Nov. 27, 2012

(54) VIBRATION ISOLATOR

(76) Inventor: Christopher Ralph Cantolino, Bradenton, FL (US)

( * ) Notice: Subject to any disclaimer, the term of this patent is extended or adjusted under 35 U.S.C. 154(b) by 467 days.

(21) Appl. No.: 12/574,062

(22) Filed: Oct. 6, 2009

Related U.S. Application Data

(63) Continuation-in-part of application No. 12/563,669, filed on Sep. 21, 2009, now Pat. No. 8,100,140.

(51) Int. Cl.
*F16M 13/00* (2006.01)

(52) U.S. Cl. ..... 267/141; 267/140; 248/615; 248/188.8; 248/677

(58) Field of Classification Search ..... 267/140, 267/141, 153, 292; 248/615, 634, 638, 673, 248/677, 678, 146, 649, 639, 632, 188.9, 248/188.8; 137/312; 220/571
See application file for complete search history.

(56) References Cited

U.S. PATENT DOCUMENTS 5,149,069 A * 9/1992 Hein ..... 267/153
5,467,970 A * 11/1995 Ratu et al. ..... 267/220
6,733,023 B2 * 5/2004 Remmert et al. ..... 280/124.179
6,857,626 B2 * 2/2005 Burlage et al. ..... 267/220
7,416,175 B2 * 8/2008 Al-Dahhan ..... 267/220
7,441,742 B2 * 10/2008 Kwon et al. ..... 248/677
7,637,387 B1 * 12/2009 Cantolino ..... 220/571
7,673,646 B1 * 3/2010 Cantolino ..... 137/15.01
7,900,795 B1 * 3/2011 Cantolino ..... 220/608
8,100,140 B1 * 1/2012 Cantolino ..... 137/312
8,220,770 B2 * 7/2012 Justis ..... 248/677
2007/0205343 A1 * 9/2007 Andreoli ..... 248/188.8
* cited by examiner

*Primary Examiner* — Bradley King
*Assistant Examiner* — Thomas Irvin
(74) *Attorney, Agent, or Firm* — Dorothy S. Morse

(57) ABSTRACT

A generally mushroom-shaped vibration isolator having a broad cap and a smaller diameter stem that is used for safety enhancement between a heavy furnace, air conditioning unit, storage hot water heater tank, or other fluid-producing unit, and a fluid-collecting pan positioned under it. Vibration isolator stems are placed within indentations in raised areas of the pan and comprise highly impact-resistant materials, temperature-resistant materials, provide enhanced air movement and heat deflection around a furnace/unit/tank, reduce after-installation furnace/unit/tank movement, and meet furnace non-combustible clearance requirements. The cap has a broad underside surface, top surface radially-extending ribs and cutouts, and may have a slightly convex top, while the stem has at least one outwardly-depending wedge-shaped projection that is sufficiently flared-out to flip over as it is inserted into an indentation for a tight fit within several sizes of indentation, as well as removal resistance. A tapered connection also exists between cap and stem.

20 Claims, 5 Drawing Sheets

FIG. 6
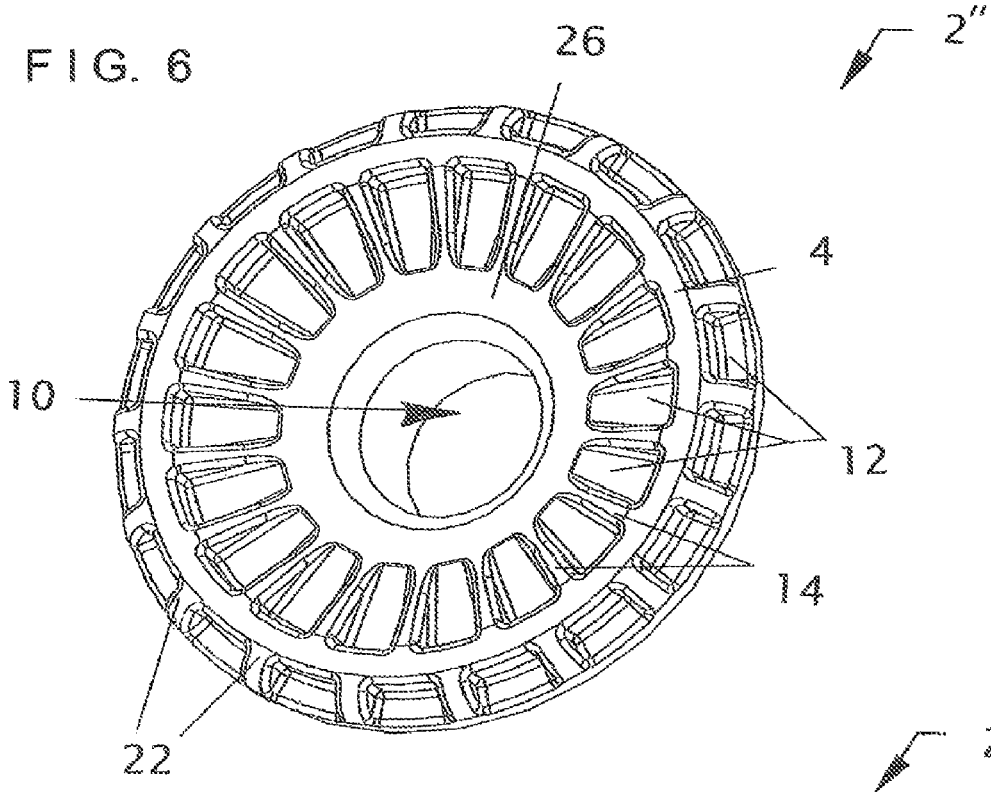
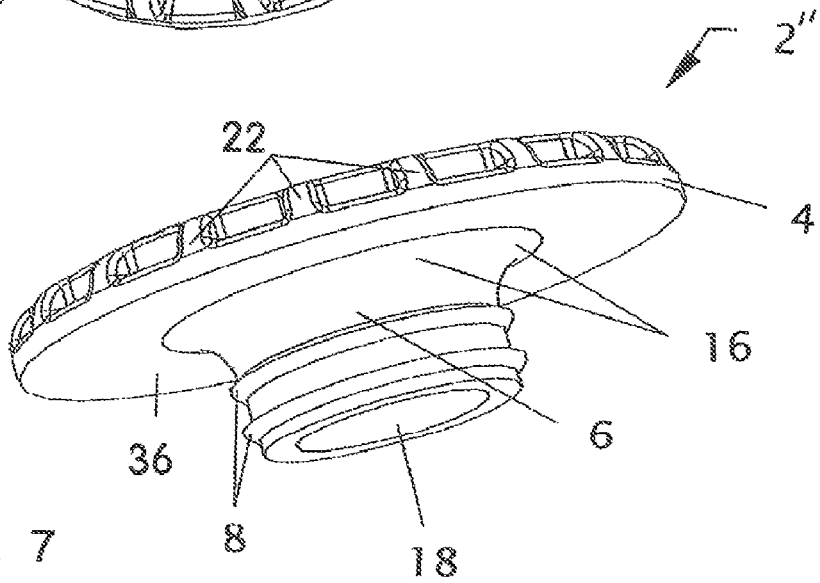
FIG. 7

VIBRATION ISOLATOR

CROSS-REFERENCES TO RELATED APPLICATIONS

This application is a continuation-in-part of a previously filed U.S. utility patent application to the same inventor, which was given the Ser. No. 12/563,669, was filed on Sep. 21, 2009, now U.S. Pat. No. 8,100,140, with overlapping subject matter to that in the new patent application now being filed. The previously filed U.S. utility patent application from which domestic priority for the instant patent application herein is desired further has a title of "Strength-Enhanced Water-Collecting Pan for Use under Storage Hot Water Heaters". Since the vibration isolator disclosed herein is shown as a preferred configuration of vibration isolator that can be used with the pan disclosed in the previously filed U.S. patent application Ser. No. 12/563,669 identified hereinabove, and the applicant has filed this new patent application in an attempt to receive patent protection solely for the vibration isolator, domestic benefit based upon this previously filed U.S. patent application identified above is herein requested for this new patent application now being filed.

BACKGROUND

1. Field of the Invention

This invention relates to accessories for pans used to collect condensate and other fluids while positioned under a heavy furnace, air conditioning unit, storage hot water heater tank, or other fluid-producing (or fluid-holding) unit presenting a risk of fluid damage to its surroundings, specifically to a highly impact-resistant and generally mushroom-shaped grommet that can be used in association with a fluid collecting tray or pan as a safety-enhancing vibration isolator that becomes fixed in position between the tray or pan and a heavy furnace, air conditioning unit, storage hot water heater tank, or other fluid-producing or fluid-holding unit presenting a risk of fluid damage to its surroundings. The present invention vibration isolator also provides an installation-assisting benefit for the heavy furnaces, air conditioning units, storage hot water heater tanks, or other fluid-producing or fluid-holding units as they are moved across a pan into their usable positions. To simplify the following description of the vibration isolator, only the term "pan" will be used hereinafter when describing its positioning, since for purposes of this disclosure the terms "pan" and "tray" are considered interchangeable. The supporting pan used with present invention vibration isolators would have a sturdy construction and typically have one or more raised areas that elevate the furnace/unit/tank above the pan's bottom surface to provide space in the pan for the collection of condensate/fluid, and also keep the furnace/unit/tank from remaining in constant contact with the collected condensate/fluid. One or more indentations or receiving holes in the top surfaces of the raised areas of the pan are each configured to receive the stem of one present invention vibration isolator, the caps of which collectively provide needed elevation and weight distribution management across the various raised areas of the pan and the bottom surface of the supported furnace/unit/tank positioned above it. Present invention vibration isolators are also configured to stay within a raised area indentation or receiving hole better than prior art grommets, thereby reducing post installation movement of the supported furnace/unit/tank relative to the pan and lessening the likelihood for vibration resulting from furnace/unit/tank operation to cause shifting of the furnace/unit/tank from its originally installed position that could lead to premature pan failure or collapse. Use of present invention vibration isolators also provides benefit to furnace/unit/tank installers, as the ribbed construction of the caps of present invention vibration isolators allows them to cushion a heavy furnace/unit/tank as it slides across the raised structure of the pan without rolling over or popping-out of the indentation into which it was placed, as prior art grommets have a tendency to do, thus protecting the underlying pan from stresses that could otherwise create weak points and/or cracks in pan materials and lead to premature pan failure or collapse.

Present invention vibration isolators are made from (or adapted with) highly impact-resistant and high-temperature resistant materials, and can also be configured and used to meet non-combustible clearance requirements in furnace applications. Present invention vibration isolators further provide the additional advantage of enhanced air movement and heat deflection around a furnace/unit. The most preferred embodiment of the present invention vibration isolator is generally mushroom-shaped, having a broad cap and a smaller diameter stem. A tapered connection also exists between cap and stem, which appears similar to illustrations of decurrent and subdecurrent mushroom gill attachment, where gills run partially down the stem. Furthermore, its cap has a diameter dimension larger than its height dimension, a top surface with a central opening, a hollow interior area communicating with the top opening, a broad underside surface, radially-extending ribs and cutouts in its top surface that assist in preventing the vibration isolator from rolling over and/or popping-out as a heavy furnace, tank, or air conditioning unit is moved across them, optional side ribs and cutouts that further assist in preventing rollover, and the cap may have a flat or slightly convex top surface, while the present invention stem has a central bore and an exterior surface with at least one outwardly-depending projection that is thicker at its top so as to create a wedge shape that resists removal from the pan indentation within which it is placed during use (even resisting rollover/removal when the heavy furnace or other fluid-producing unit is slid across the top surface of the pan during installation), with the distal tips of the projection or projections also being sufficiently flared-out to flip over as they are inserted into an indentation to provide the versatility of a tight fit within more than one size of indentation or receiving hole. The folding over of the projection tips as a present invention vibration isolator stem starts to pull out of an indentation also provides resistance to separation of the isolator from the indentation or receiving hole. A first preferred embodiment shown in the accompanying illustrations has a small opening in a domed cap, and two projections extending outwardly from its stem. A second preferred embodiment of present invention vibration isolator is also disclosed herein that has projections father spaced apart than in the first preferred embodiment, while a third preferred embodiment has a wider diameter top opening in a cap with a flat top area, an increased number of ribs that enhances its vibration reducing effectiveness, and side ribs on its cap that further enhance vibration dampening performance.

2. Description of the Related Art

When air conditioning condensate and other condensates/fluids are collected to prevent a risk of damage to surroundings, overflow and/or back-up into the system producing it may occur. As a result, a fluid collection and/or drain pan placed under the condensate-producing unit typically has a liquid-level-monitoring switch mounted on the pan that sends a shut-off signal to the source of condensate flow to stop it when the amount of fluid collected exceeds a predetermined depth considered safe. However, there are many challenges associated with fluid management through the use of such pans. If a condensate-producing unit (such as an air conditioning system air handler) is installed in an attic, on hot summer days a fluid collection pan under an air conditioning system air handler can be subjected to temperatures exceeding 140-degrees Fahrenheit, which may lead to perimeter wall lean-in and float switch malfunction. Other problems associated with fluid collection pan installation involve installation sites that expose fluid collection pans to significant seasonal temperature fluctuations and tight spaces that require installers to bend, twist, and/or step on a pan at least once before installation is complete. Pans installed for support of furnaces and other units responsible for fluid damage risk to their surroundings may also be subject to temperature and space limitation issues similar to that experienced in air conditioning applications, and in addition furnace installations typically require a designated amount of non-combustible clearance. Furthermore, in addition to the challenge of installing them in tight spaces, furnaces, air conditioning units, and storage hot water heater tanks are typically heavy, so the furnaces/units/tanks are not usually raised over a fluid collection pan and then lowered down onto its raised support surfaces. Instead, they are typically slid across the raised surfaces of a fluid collection pan. Thus, any vibration isolators to be used between the bottom surface of the furnace/unit/tank and the raised support surfaces of the fluid collection pan must be set into place before the furnace/unit/tank is slid across the raised support surfaces, and the vibration isolators must be configured to remain in their designated position of use while the furnace/unit/tank is moved across them. However some prior art vibration isolators come loose from their original positions as a result of the movement of a furnace/unit/tank across them, disrupting the optimal weight distribution management contemplated for the pan. The flat or slightly convex top area of the cap of present invention vibration isolators, in combination with the array of ribs and cutout areas thereon, as well as the wedge-shaped projections outwardly depending from its smaller diameter stem, all work together to maintain present invention vibration isolators in their original locations within a designated indentation or receiving hole in a pan and resist rollover and/or popping-out, allowing for optimal performance of both vibration isolator and pan. Materials selected for fluid collection pans are chosen for their strength and temperature resistance, as well as high impact resistance and corrosion resistance. Although present invention vibration isolators preferably would be made from different materials than the pans supporting them, materials selected for the present invention vibration isolators must have many of the same characteristics as pan materials, and in furnace applications they would also comprise high-temperature resistance and sufficient height dimension to meet the non-combustible clearance requirements. No other vibration isolator is known with the same structure, to function in the same manner as the present invention vibration isolator herein, or provide all of its advantages.

BRIEF SUMMARY OF THE INVENTION

It is the primary object of this invention to provide a vibration isolator of sturdy/rugged construction for use between a fluid collection pan and a furnace, air conditioning unit, storage hot water heater tank, or other fluid-producing or fluid-containing unit, which comprises materials and a configuration that prevent movement of the furnace/unit/tank from its originally established position relative to the fluid collection pan beneath it. A further object of this invention is to provide a vibration isolator that helps to raise a furnace/unit/tank above the maximum depth intended for routine condensate/fluid collection in the pan, so that the furnace/unit/tank is not in constant contact with collected condensate/fluid. It is also an object of this invention to provide a vibration isolator that is configured to resist rollover and/or popping-out when a heavy furnace/unit/tank is moved across it. A further object of this invention is to provide a vibration isolator made from materials that are strong, impact-resistant, heat resistant, non-flammable, impervious to corrosion, unaffected by extreme ambient temperature fluctuations, and have resistance to buckling, bowing, warping, distortion, and collapse during extended use. It is a further object of this invention to provide a vibration isolator that can be used to meet non-combustible clearance requirements in furnace installations. It is also an object of this invention to provide a vibration isolator providing features that increase vibration dampening, while concurrently reducing material cost.

The present invention, when properly made and used, provides a highly impact-resistant grommet used as a safety-enhancing vibration isolator between a heavy furnace, air conditioning unit, storage hot water heater tank, or other fluid-producing or fluid collecting unit presenting a risk of fluid damage to its surroundings and the fluid-collecting tray or pan placed under it. Raised supports with top receiving holes or indentations elevate the furnace/unit/tank, and one present invention vibration isolator per hole/indentation collectively provides weight distribution management for the pan and reduces the opportunity for the furnace/unit/tank to move relative to the pan, thereby preventing premature pan failure and/or collapse. The present invention vibration isolators can comprise high-temperature resistant materials, provide enhanced heat deflection around a supported furnace/unit, and can be sized to meet non-combustible clearance requirements in furnace applications. The present invention vibration isolators also each have a generally mushroom-shaped cap with a flat or slightly convex top area that is in contact with the heavy furnace or fluid-producing unit during its use, a central opening in the top area of the cap that communicates with a hollow interior area, and multiple spaced-apart ribs each separated by a cutout area on the cap's exterior surface and radially extending from the top area and fully around it. As the number of ribs increases on each present invention vibration isolator without diminishing the caps material strength, in addition to a reduction in material cost, the caps vibration isolating capability is enhanced. Each present invention vibration isolator also has a substantially cylindrical stem depending downwardly from its broad cap and a central bore communicating with the central opening of the cap. The substantially cylindrical stem also has at least one (but preferably two) spaced-apart, wedge-shaped, removal-resisting projection outwardly extending from the bottom part of its exterior surface that during use is in contact with a receiving hole or indentation in a fluid collection pan positioned under the furnace, tank, or fluid-producing unit. The top surface area in the cap, multiple radially-extending ribs, flared connection between cap and stem, and at least one wedge-shaped projection on its stem, all work together to resist rollover when a heavy furnace of air conditioning unit is moved across the present invention vibration isolators, which allow each one to haveretain an optimal configuration and be in an optimal orientation to collectively provide safety-enhancing contact between the support surfaces of the pan and the bottom surface of the supported fluid-causing unit for weight distribution management that reduces the opportunity for movement of supported furnace/tank/unit relative to the pan, thereby lessening the likelihood of premature pan collapse. In addition, the tapering connection of the present invention cap and stem, where cap material runs partially down the stem, provides a non-angular surface that conforms to the top edge of the receiving hole or indentation into which it is placed also assists in rollover prevention.

The description herein provides preferred embodiments of the present invention but should not be construed as limiting its scope. For example, variations in the positioning of projections; the spaced-apart distance between projections; the width and depth dimensions of the cutouts between adjacent ribs in the cap; the size and shape of the top opening in the cap; the wall thickness of the substantially cylindrical stem; the number of ribs used in the cap; the length dimension of cap material running down the exterior surface of the stem, and the amount of convex curvature in the cap, if any, other than those shown and described herein, may be incorporated into the present invention. Thus, the scope of the present invention should be determined by the appended claims and their legal equivalents, rather than being limited to the examples given.

BRIEF DESCRIPTION OF THE DRAWINGS

FIG. 6 is a top view of a third preferred embodiment of the present invention vibration isolator having side ribs, and a greater number of top ribs and a wider top opening that is shown in FIGS. 1, 2, and 4.

FIG. 7 is a side view of the third preferred embodiment of the present invention showing a more flattened cap configuration than is shown in FIGS. 1-5.

DETAILED DESCRIPTION OF PREFERRED EMBODIMENTS

Figure 1:
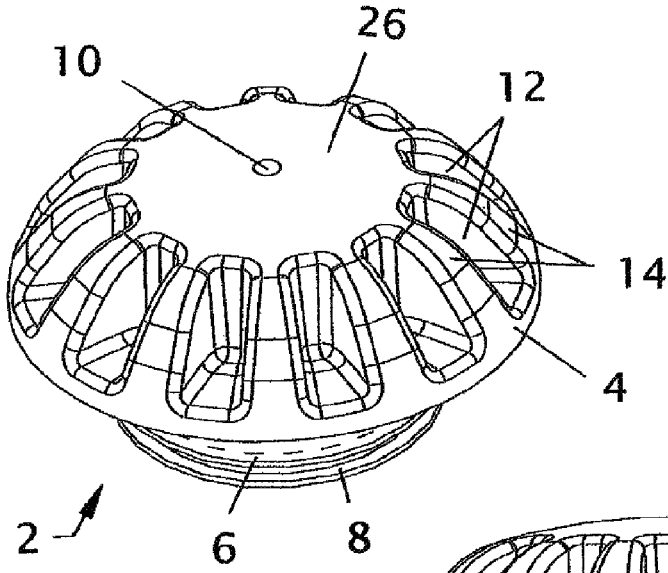
FIG. 1 is a perspective view of a first preferred embodiment of the present invention vibration isolator having a mushroom-like appearance with a dome-shaped cap that is slightly convex on its top surface (which would be in contact with a heavy furnace or fluid-producing unit during vibration isolator use), a width dimension that is greater than its height dimension, a small opening centrally through the top surface, and multiple spaced-apart ribs each separated by a cutout area radially extending from the top surface and fully around it, with the vibration isolator shown also having a substantially cylindrical stem depending downwardly from the cap, the stem having a central bore communicating with the top opening and two spaced-apart, wedge-shaped, removal-resisting projections outwardly extending from the bottom part of the substantially cylindrical stem that during vibration isolator use is in contact with the side walls of a receiving hole or indentation in a fluid collection pan positioned under a furnace or fluid-producing unit.
Figure 2:
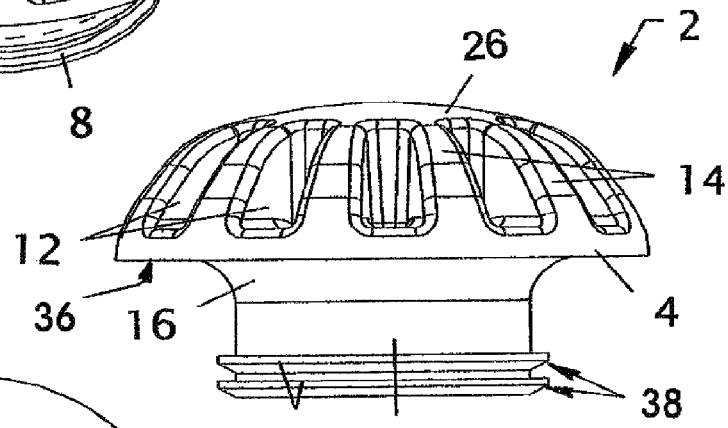
FIG. 2 is a side view of the first preferred embodiment of the present invention vibration isolator having a strength-enhancing flared connection between its cap and stem where cap material runs partially down the stem.
Figure 3:
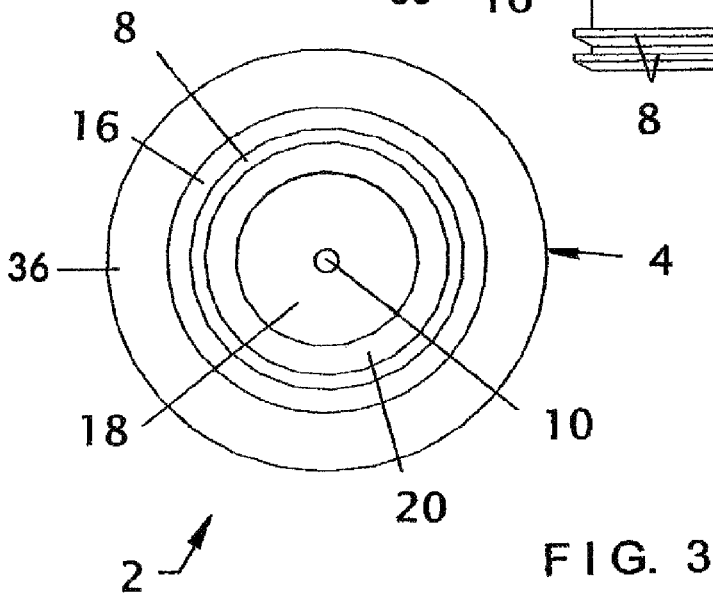
FIG. 3 is a bottom view of a vibration isolator in the first preferred embodiment of the present invention showing the small top opening in the dome-shaped cap in the center of the illustration, a bore through the substantially cylindrical stem positioned around the top opening, the wall thickness of the stem around the bore, the bottommost projection outwardly depending from the exterior surface of the stem positioned around the wall thickness, the strength-enhancing flared connection between the vibration isolator's cap and stem positioned around the bottommost projection, and the broad bottom surface of the dome-shaped cap forming the outer perimeter of the illustration.
Figure 4:
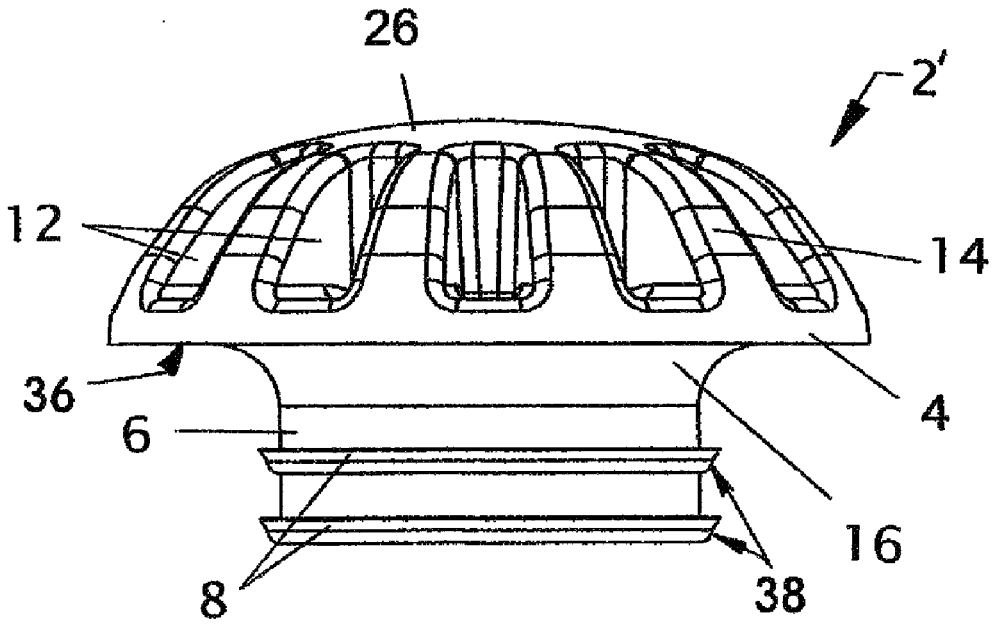
FIG. 4 is a side view of a second preferred embodiment of the present invention vibration isolator having its projections separated more from one another than is shown for the first preferred embodiment in FIG. 2.
Figure 5:
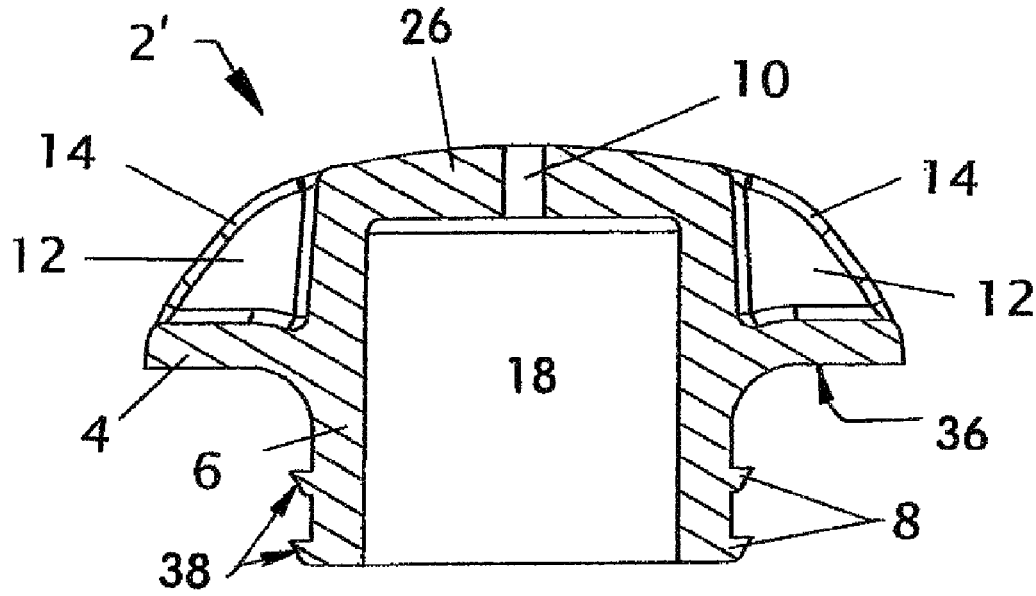
FIG. 5 is a sectional view of the second preferred embodiment of the present invention showing the upper and stems having a sturdy construction with a thickened wall dimension and the bore through the substantially cylindrical stem positioned below the top opening and in communication with it.
Figure 8:
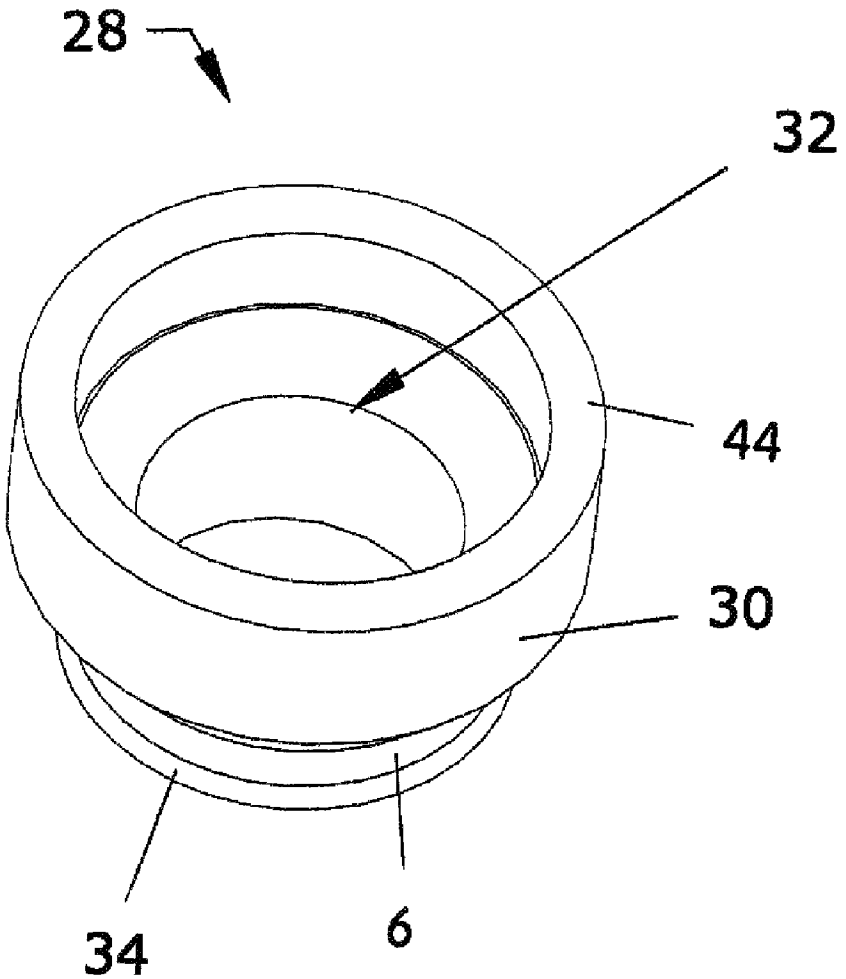
PRIOR ART FIG. 8
FIG. 8 is a perspective view of a prior art vibration isolator having a generally tubular upper portion on a stem having one non-tapered flange extending outwardly from its bottom exterior surface.
Figure 9:
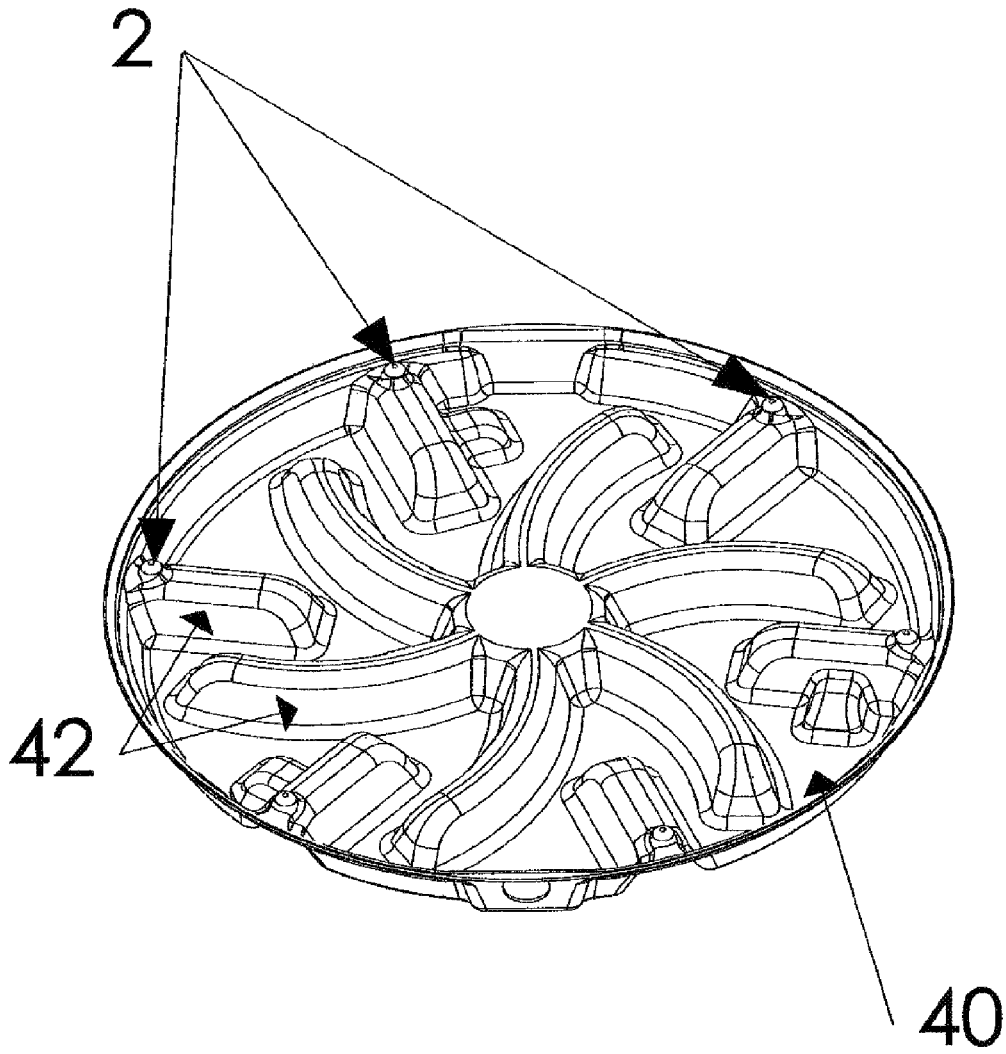
FIG. 9 is a side view of several present invention isolators each positioned within an indentation in a different raised surface area of a fluid-collecting pan.

The present invention is a highly impact-resistant grommet used as a safety-enhancing vibration isolator between a heavy furnace, air conditioning unit, storage hot water heater tank, or other unit presenting a risk of fluid damage to its surroundings and the fluid-collecting tray or pan placed under it (such as, but not limited to, pan 40 in FIG. 9). Raised areas 42 in pan 40 with top receiving holes or indentations elevate the furnace/unit/tank (not shown), and one present invention vibration isolator 2 per hole/indentation collectively provide weight distribution management for pan 40 and reduce the opportunity for the furnace/unit/tank to move relative to pan 40 and cause premature pan 40 failure and/or collapse. The present invention vibration isolators comprise high-temperature resistant materials, provide enhanced heat deflection around a supported furnace/unit/tank, and can be sized to meet non-combustible clearance requirements in furnace applications. The present invention vibration isolators also each have a generally mushroom-shaped cap 4 with a top opening 10, a top area 26 around opening 10, and multiple ribs 14 radiating outwardly from top area 26 that help to prevent rollover of cap 4 during furnace/unit/tank installation. There is also a flared connection 16 between cap 4 and the stem 6 depending from it, wherein cap 4 material partially runs down stem 6, and a hollow bore 24 through substantially cylindrical stem 6 that communicates with top opening 10. In addition, at least one (but preferably two) wedge-shaped, removal-resisting projection 8 outwardly depends from stem 6. FIGS. 1-3 show a first preferred embodiment 2 of the present invention, while FIGS. 4 and 5 show a second preferred embodiment 2' of the present invention with two projections 8 that are spaced farther apart from one another than the projections 8 shown in FIGS. 1-3. FIGS. 6 and 7 also show a third preferred embodiment 2" of the present invention with a greater number of top ribs 14, a wider top opening 10, and side ribs 22. Furthermore, FIG. 8 shows a prior art grommet for comparison to present invention features and structure, and FIG. 9 shows several present invention vibration isolators each positioned within a top surface hole/indentation of a different raised area 42 in a fluid-collection pan 40. It is to be understood that many variations in the present invention vibration isolators are possible and also considered to be a part of the invention disclosed herein, even though such variations are not specifically mentioned or shown. As a result, a reader should draw conclusions about the present invention, and determine its scope by reviewing the appended claims.

FIGS. 1-3 show a first preferred embodiment 2 of the present invention. FIG. 1 is a perspective view of a first preferred embodiment 2 of the present invention vibration isolator having a dome-shaped cap 4 with a slightly convex top area 26. It is top area 26 that is in contact with a heavy furnace, tank, or fluid-producing unit during present invention use. FIG. 1 also shows a small top opening 10 centrally through top area 26, and multiple spaced-apart ribs 14 that are each separated by a cutout area 12. As can be seen in FIGS. 1 and 2, the perimeter configuration of each cutout area 12 when viewed from one of its opposing sides is substantially that of a circular sector. The spaced-apart ribs 14, and alternating cutout areas 12, are both adjacent to top area 26 and extend radially from it, as well as fully around it. Furthermore, FIGS. 1-3 show the vibration isolator in first preferred embodiment 2 also having a substantially cylindrical stem 6 depending downwardly from cap 4, and FIG. 3 shows stem 6 having a central bore 18 communicating with the top opening 10 in cap 4 and the wide underside surface 36 of cap 4. FIG. 1 further shows two spaced-apart, wedge-shaped, removal-resisting projections 8 outwardly extending from the bottom part of stem 6 that during use of first preferred embodiment 2 are in contact with the side walls of a hole/indentation in a fluid collection pan 40 positioned under a furnace, tank, or fluid-producing unit (not shown). FIG. 2 is a side view of first preferred embodiment 2 of the present invention vibration isolator having a strength-enhancing flared connection 16 between cap 4 and stem 6 that comprises cap 4 material running partially down stein 6, as in decurrent and subdecurrent gill attachment generally depicted for mushrooms. FIG. 2 also shows that the width dimension of first preferred embodiment 2 exceeds its height dimension, providing for a wide underside surface 36 for cap 4. FIG. 2 further shows the tapered tip 38 of the wedge-shaped projections 8 on stem 6. In addition, FIG. 3 is a bottom view of a vibration isolator in first preferred embodiment 2 of the present invention showing the relatively small opening 10 in the dome-shaped cap 4 being placed in the center of the illustration, the bore 18 through the substantially cylindrical stem 6 positioned around top opening 10 and communicating with opening 10, the wall thickness 20 of stem 6 surrounding bore 18, the bottommost projection 8 outwardly depending from stem 6 surrounding wall thickness 20, the strength-enhancing flared/tapered connection 16 between cap 4 and stem 6 of the present invention 2 of the vibration isolator 2 positioned around bottommost projection 8, and the relatively wide underside surface 36 of dome-shaped cap 4 forming the outer perimeter of the illustration. The upper projection 8 is not separately identified in FIG. 3, as it remains hidden behind the bottommost projection 8.

FIGS. 4 and 5 show a second preferred embodiment 2' of the present invention with two projections 8 on stem 6 that are spaced farther apart from one another than those shown in FIGS. 1-3, and each projection 8 having a tapered tip 38 configured for removal resistance. The remaining features of second preferred embodiment 2' are substantially similar to those shown in FIGS. 1-3, as identified below. FIG. 4 is a side view of second preferred embodiment 2' of the present invention vibration isolator having projections 8 more widely spaced apart from one another than is shown for the first preferred embodiment in FIG. 2, for applications where even more removal resistance for stem 6 is required by an application. FIG. 4 further shows second preferred embodiment 2' having a top opening 10 through a slightly convex top area 26 in cap 4, with ribs 14 and cutout areas 12 radially-extending from top area 26 in all direction completely around cap 4. FIG. 4 also shows the strength-enhancing flared connection 16 between cap 4 and stem 6 that comprises cap 4 material running partially down stem 6, as in decurrent and subdecurrent gill attachment generally depicted for mushrooms. FIG. 5 is a sectional view of the second preferred embodiment 2' of the present invention showing cap 4 and stem 6 each having a sturdy/rugged construction and the bore 18 through the substantially cylindrical stem 6 positioned below the smaller top opening 10 and in communication therewith. FIG. 5 also identifies two ribs 14 and two cutout areas 12, each adjacent to a different rib 14. Although the wider separation between projections 8 and the tapered distal tip 38 of each projection 8 that are both shown in FIGS. 4 and 5 is preferred, both should be considered as optional, as the spaced-apart distance needed between projections 8 will depend at least in part upon the application and the wall thickness 20 of stem 6. The number ribs 14 and cutout areas 12 used in the present invention may also vary in differing embodiments of the present invention, as well as the width, height, and depth dimensions of cutout areas 12. Furthermore, the size and cross-sectional configuration of top opening 10 is not limited to that shown in FIGS. 1 and 5 (see FIGS. 6 and 7 for comparison), nor is the amount of convex curvature in top area 26 (also see FIGS. 6 and 7 for comparison). With all of its rollover-resisting features, the safety-enhancing present invention vibration isolators help to better manage the weight balance distribution of the pans (40 or other) supporting heavy a furnace, tank, and/or air conditioning unit during its operation, reducing the risk of fluid damage to their surroundings.

FIGS. 6 and 7 show a third generally mushroom-shaped preferred embodiment 2" of the present invention having a flatter cap 4 configuration and a wider central opening 10 through top area 26. The width dimension of cap 4 in the third preferred embodiment 2" exceeds its height dimension, providing a wide underside surface 36 for cap 4. FIG. 6 is a top view of a third preferred embodiment 2" of the present invention vibration isolator showing its wider central opening 10, more ribs 14 around top area 26 than in FIGS. 1, 2, and 4, and side ribs 22 that further assist in achieving vibration dampening while also providing material cost reduction. FIG. 7 is a side view of the third preferred embodiment 2" of the present invention showing a more flattened configuration for cap 4 than is shown in FIGS. 1-5. FIG. 7 also shows the bottommost projection 8 spaced apart from the bottom end of stem 6. Although not marked with the number 38 in FIG. 7, the tapered tip of each projection 8 is also visible. FIG. 8 is a perspective view of a prior art grommet 28 having a generally tubular upper portion 30, no top surface area 26 for contact with the bottom surface of a furnace, tank, or fluid-producing unit, and with the only contact area provided being the top edge 44 of the upstanding wall of tubular upper portion 30 depending from a stem 6 having a single non-tapered projection 34 outwardly extending therefrom. The combination of the tubular shape of upper portion 30 and the thin top edge 44, do not resist rollover as well as the preferred embodiments of the present invention. FIG. 9 is a side view of several present invention vibration isolators 2 each positioned within a receiving hole or indentation (covered by vibration isolators 2) in a different raised surface area 42 of a fluid-collecting pan 40.

Projections 8 must have a flared-out/wedge-shaped configuration with a tapered distal tip 38 configured so that the distal tip 38 will flip over and be able to accommodate the positioning of projections 8 in different sizes of receiving holes or indentations in a fluid-collection pan (40 or other). Projections 8 must also be configured so that its attached stem 6 will not pop out of an indentation or receiving hole when a heavy furnace/tank/unit (not shown) slides across it during installation. Furthermore, the larger diameter cap 4 and its relatively larger underside surface 36, also help to prevent rollout during heavy furnace/tank/unit installation. Also, cap 4 has a solid top area 26 that facilitates the successful sliding of furnaces/tanks/units over it. In addition, the cutouts 12 that help to form the vibration dampening ribs 14, also help to decrease the material cost of vibration isolators 2, 2', 2", and other. The flared/tapering connection 16 between cap 4 and stem 6 helps present invention vibration isolator (2, 2', 2", and other) to conform to the top edge of an indentation or receiving hole in a fluid-collecting pan (such as but not limited to the pan 40 shown in FIG. 9), for a better fit and less likelihood of easy removal as the furnace/unit/tank installation is moved across it during installation.

Thus, as a result of the structure identified hereinabove, the present invention is a highly impact-resistant vibration isolator 2, 2', 2" (or other) of generally mushroom-shaped construction that is used for safety enhancement between a heavy furnace, air conditioning unit, storage hot water heater tank, or other unit presenting a risk of fluid damage to its surroundings and the fluid-collecting tray or pan 40 (see FIG. 9) placed under it. Raised areas 42 in pan 40 (each with a top receiving hole or indentation) elevate the furnace/unit/tank (not shown) above collected fluid so that the furnace/unit/tank is not continually exposed to collected fluid to reduce deteriorating effects of corrosion and mold thereto, and one present invention vibration isolator (2, 2', 2" or other) per selected receiving holes or indentations collectively provides weight distribution management for the pan and reduces the opportunity for the furnace/unit/tank to move relative to pan 40 from its originally installed position and risk premature pan failure or collapse. The present invention vibration isolators (2, 2', 2" or other) comprise high-temperature resistant materials, provide enhanced heat deflection around a supported furnace/unit/tank, and can be configured and sized to meet non-combustible clearance requirements in furnace applications. Each present invention vibration isolator also preferably has a diameter dimension larger than its height dimension, a flat or slightly convex mushroom-shaped cap 4 with a central opening 10, a hollow interior within cap 4 that communicates with top opening 10 and the bore 18 through stem 6, cutout areas 12 in the exterior surface of cap 4 radially-extending from opening 10 fully around cap 4 that form a plurality of vertically-extending ribs 14 therebetween, optional side ribs 22, and at least one wedge-shaped projection 8 outwardly-depending from the exterior surface of stem 6 that is sufficiently flared-out (and/or otherwise having a tapered distal tip 38) to allow it to flip over as it is inserted into a receiving hole or indentation in the top surface of a raised support 42 in a fluid-collection pan (40 or other), which provides a tight fit within more than one size of receiving hole or indentation in raised support 42, as well as enhanced removal resistance.

What is claimed is:

1. A safety-enhancing vibration isolator for use between fluid collecting trays and pans and heavy furnaces, air conditioning units, and storage hot water heater tanks that are supported upon fluid-collecting trays and pans and present a risk of fluid damage to surroundings, said vibration isolator comprising:

a broad dome-shaped cap having a width dimension, a height dimension, and an exterior surface, said width dimension being larger than said height dimension, said cap also having a top area with a small opening centrally therethrough, an interior hollow area communicating with said centrally-located opening, and multiple spaced-apart exterior ribs each separated from the next adjacent one of said ribs by a cutout area in said cap's exterior surface, said ribs radially extending from said top area and located fully around said top area, and said cutout areas each having opposing sides with a perimeter configuration substantially that of a circular sector;

a substantially cylindrical stem depending downwardly from said cap, said stem also having a diameter dimension smaller than said width dimension of said cap, a central bore communicating with said interior hollow area and said central opening in said cap, said stem further having at least one wedge-shaped projection outwardly-extending therefrom; and a flared connection between said cap and said stem, so that when said slightly convex top area is in contact with a heavy furnace or fluid-producing unit and said stem is at least partially positioned within a raised support in a fluid collection pan positioned under the furnace or fluid-producing unit, said dome-shaped cap, in combination with said ribs, said cutout areas, and said wedge-shaped projections work together to resist rollover of said vibration isolator when a furnace or air conditioning unit is moved over said cap during installation, and provide enhanced safety for the furnace or air conditioning unit, storage hot water heater tank, the pan, and areas surrounding the pan as a result of enhanced weight distribution management in the pan.

2. The vibration isolator of claim 1 wherein said at least one projection has a tapered distal tip.

3. The vibration isolator of claim 1 wherein said at least one projection has a tapered distal tip configured to flip over and to accommodate the positioning of said projections in more than one size of receiving hole.

4. The vibration isolator of claim 1 wherein said stem has two of said projections in spaced-apart array from one another.

5. The vibration isolator of claim 1 further comprising material selected from high-temperature resistant materials, highly impact-resistant materials, high-strength materials, impact-resistant materials, heat resistant materials, non-flammable materials, materials impervious to corrosion, materials unaffected by extreme ambient temperature fluctuations, and materials resistant to buckling, bowing, warping, distortion, and collapse during extended use.

6. The vibration isolator of claim 1 wherein said top area has a configuration selected from a group consisting of flat top areas and slightly convex top areas.

7. The vibration isolator of claim 1 wherein said central bore of said stem has a larger diameter dimension than said top opening.

8. The vibration isolator of claim 1 wherein said stem has a distal end and said at least one projection extends outwardly from said distal end.

9. The vibration isolator of claim 1 wherein said stem has a distal end and wherein said at least one projection extends outwardly from said stem at a spaced-apart distance from its distal end.

10. The vibration isolator of claim 1 wherein said stem has two of said projections in spaced-apart array from one another, further wherein said projections each have a tapered distal tip configured to flip over and accommodate the positioning of said projections in more than one size of receiving hole, wherein said top opening has a diameter dimension much smaller that said top area, and also wherein said top area has a slightly convex surface configuration.

11. The vibration isolator of claim 1 wherein said interior hollow area in said cap has a diameter dimension much larger than said top opening.

12. The vibration isolator of claim 1 wherein said flared connection between said cap and said stem comprises cap material running partially down said stem.

13. The vibration isolator of claim 12 wherein said flared connection has a decurrent configuration.

14. The vibration isolator of claim 12 wherein said flared connection has a subdecurrent configuration.

15. The vibration isolator of claim 1 wherein said at least one projection has a tapered distal tip and said top area has a slightly convex surface configuration.

16. The vibration isolator of claim 1 wherein said stem has a distal end and two of said projections in spaced-apart array from one another so as to create a bottommost projection, and said bottommost projection is selected from a group consisting of projections spaced-apart from said distal end, and projections located at said distal end.

17. The vibration isolator of claim 1 wherein said at least one projection has a tapered distal tip, said top area has a slightly convex surface configuration, and wherein said flared connection between said cap and said stem comprises cap material running partially down said stem.

18. The vibration isolator of claim 17 wherein said flared connection has a decurrent configuration.

19. The vibration isolator of claim 17 wherein said flared connection has a subdecurrent configuration.

20. The vibration isolator of claim 1 wherein said stem has two of said projections in spaced-apart array from one another, said top area has a slightly convex surface configuration, said flared connection between said cap and said stem comprises cap material running partially down said stem, and further wherein at least one of said projections has a tapered distal tip.

* * * * *